US010137587B2

(12) United States Patent
Kärnä

(10) Patent No.: US 10,137,587 B2
(45) Date of Patent: Nov. 27, 2018

(54) AXE AND AXE HEAD

(71) Applicant: Heikki Kärnä, Västerskog (FI)

(72) Inventor: Heikki Kärnä, Västerskog (FI)

( * ) Notice: Subject to any disclaimer, the term of this patent is extended or adjusted under 35 U.S.C. 154(b) by 183 days.

(21) Appl. No.: 15/114,683

(22) PCT Filed: Jan. 26, 2015

(86) PCT No.: PCT/FI2015/050045
§ 371 (c)(1),
(2) Date: Jul. 27, 2016

(87) PCT Pub. No.: WO2015/110708
PCT Pub. Date: Jul. 30, 2015

(65) Prior Publication Data

US 2016/0354941 A1 Dec. 8, 2016

(30) Foreign Application Priority Data

Jan. 27, 2014 (FI) ..... 20145084

(51) Int. Cl.
*B26B 23/00* (2006.01)

(52) U.S. Cl.
CPC ..... *B26B 23/00* (2013.01)

(58) Field of Classification Search
CPC ..... B25G 3/02; B26B 23/00
USPC ..... 30/308.1
See application file for complete search history.

(56) References Cited

U.S. PATENT DOCUMENTS 4,199,016 A * 4/1980 Eads ..... B26B 23/00 30/308.3
4,294,298 A * 10/1981 Otte, Jr. ..... B27L 7/005 144/195.5
4,300,606 A 11/1981 Branson
4,357,974 A * 11/1982 Nannen ..... B27L 7/06 144/195.7

(Continued)

FOREIGN PATENT DOCUMENTS

CA 2380788 A1 * 10/2003
DE 1 953 198 U 1/1967

(Continued)

OTHER PUBLICATIONS

International Search Report (PCT/ISA/210) dated Apr. 22, 2015, by the European Patent Office as the International Searching Authority for International Application No. PCT/FI2015/050045.

(Continued)

*Primary Examiner* — Hwei C Payer
(74) *Attorney, Agent, or Firm* — Buchanan Ingersoll & Rooney PC

(57) ABSTRACT

An axe includes an axe head and a handle. The axe head having a first handle attaching structure, which extends from a first side edge of a frame section and which is located on a first axe head side of the axe head and having a second handle attaching structure, which extends from a second side edge of the frame section and which is located on the first axe head side of the axe head. The frame section of the axe head, the first handle attaching structure of the axe head, the second handle attaching structure of the axe head are parts of a one-piece structure formed by plastically deforming and cutting a flat blade stock of generally uniform thickness.

18 Claims, 7 Drawing Sheets

(56) References Cited

Figure 1:
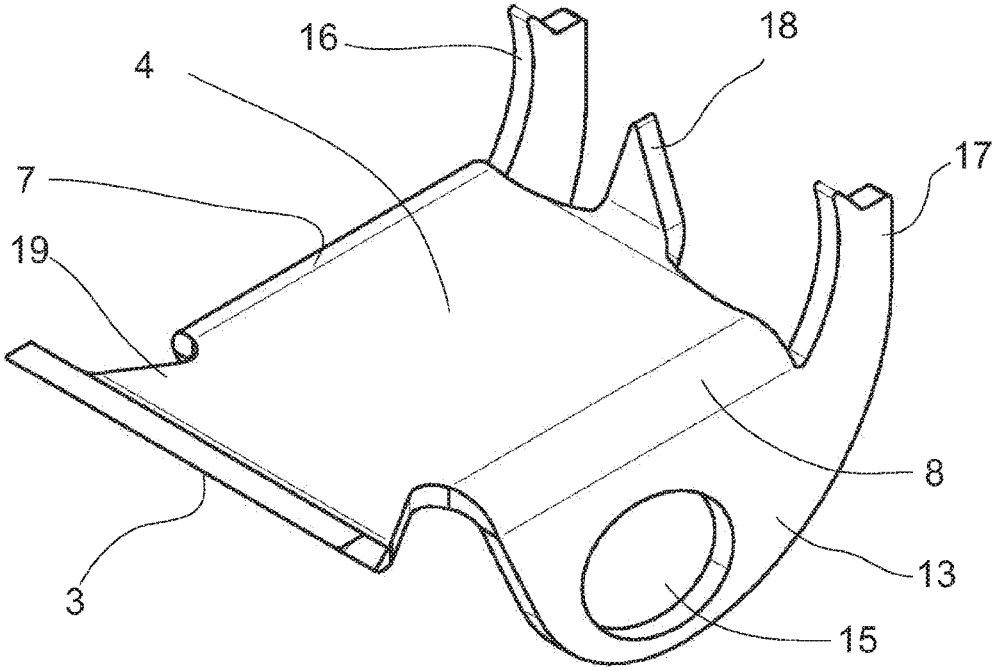

U.S. PATENT DOCUMENTS 4,412,572 A * 11/1983 Clark ..... B26B 23/00 30/308.1
4,445,555 A * 5/1984 Klempirik ..... B27L 7/06 144/195.7
4,456,044 A * 6/1984 Cloncs ..... B27L 7/06 144/195.7
4,522,240 A * 6/1985 Green ..... B27L 7/06 144/195.8
4,537,235 A * 8/1985 Aderneck ..... B26B 23/00 144/195.5
4,586,258 A 5/1986 Burke
4,817,221 A * 4/1989 Ryan ..... B25F 1/02 30/123.7
5,090,125 A * 2/1992 Sogan ..... B27L 7/005 144/195.7
5,141,353 A * 8/1992 Meredith, Jr. ..... B25G 1/10 294/57
5,152,065 A * 10/1992 Harding ..... B25G 3/24 30/308.3
8,925,207 B2 * 1/2015 Karna ..... B26B 23/00 144/195.5
2012/0036723 A1 2/2012 Karna
2016/0354941 A1 * 12/2016 Karna ..... B26B 23/00

FOREIGN PATENT DOCUMENTS

GB 807893 * 1/1959
WO WO 02/062539 A1 8/2002
WO WO 2010/122230 A1 10/2010
WO WO 2017/182710 A1 * 10/2017

OTHER PUBLICATIONS

Written Opinion (PCT/ISA/237) dated Apr. 22, 2015, by the European Patent Office as the International Searching Authority for International Application No. PCT/FI2015/050045.
Search Report dated Sep. 30, 2014, by the Finnish Patent and Registration Office in corresponding European Patent Application No. 20145084.

* cited by examiner

AXE AND AXE HEAD

FIELD OF THE INVENTION

The invention relates to an axe as defined in the preamble of independent claim 1.

The invention also relates to an axe head as defined in the preamble of independent claim 11.

Publication U.S. Pat. No. 4,199,016 presents an axe comprising a blade formed of flat plate stock of generally uniform thickness, and a U-shaped handle attaching strap formed of flat plate stock of generally uniform thickness, the strap is fixedly mounted on a handle end portion with the bight portion and leg portions thereof substantially circumferentially surrounding the handle end portion and free end portions thereof extending therefrom in generally parallel relation beyond a leading edge of the handle end portion. The blade is rigidly mounted with its attaching portion disposed between the free end portions of the attaching strap and a trailing edge thereof facing the leading edge of the handle portion. The cutting edge of the blade is of uniform wedge-shaped cross-sectional configuration throughout its extent, the wedge shape being formed by generally straight bevel surfaces.

Publication WO 02/062539 presents an axe comprising a blade provided with a cutting edge at one end, and a handle. The centre of gravity of the axe is located at a distance from the cutting edge of the blade and lies in a centre-of-gravity plane of the axe located at a distance from a blade plane of the axe parallel with both the centre-of-gravity plane and a normal working motion plane of the axe. The cutting edge of the blade and the centre of gravity of the axe are arranged to cooperate when the blade hits wood and the cutting edge of the blade partly penetrates into the wood such that at least some of the impact force of the blade is converted into a rotational motion. On the side of the blade plane of the axe on which the centre of gravity of the axe lies, the axe is equipped with first stop elements arranged to hit the wood during the rotational motion of the blade.

Publication WO 2010/122230 presents an axe comprising a blade provided with a cutting edge at one end, and a handle, and in which the centre of gravity of the axe is located at a distance from the cutting edge of the axe and lies in a centre-of-gravity plane of the axe located at a distance from a blade plane of the axe parallel with both the centre-of-gravity plane and a normal working motion plane of the axe, and in which the cutting edge of the blade and the centre of gravity of the axe are arranged to cooperate when the blade hits wood and the cutting edge of the blade partly penetrates into the wood such that at least some of the impact force of the blade is converted into a rotational motion and a motion of the blade in a curvilinear trajectory, the blade is attached to the handle so that the handle is uncircled by the blade.

OBJECTIVE OF THE INVENTION

The object of the invention is to provide an improve axe and an improved axe head that is easy to manufacture.

LIST OF FIGURES

Figure 2:
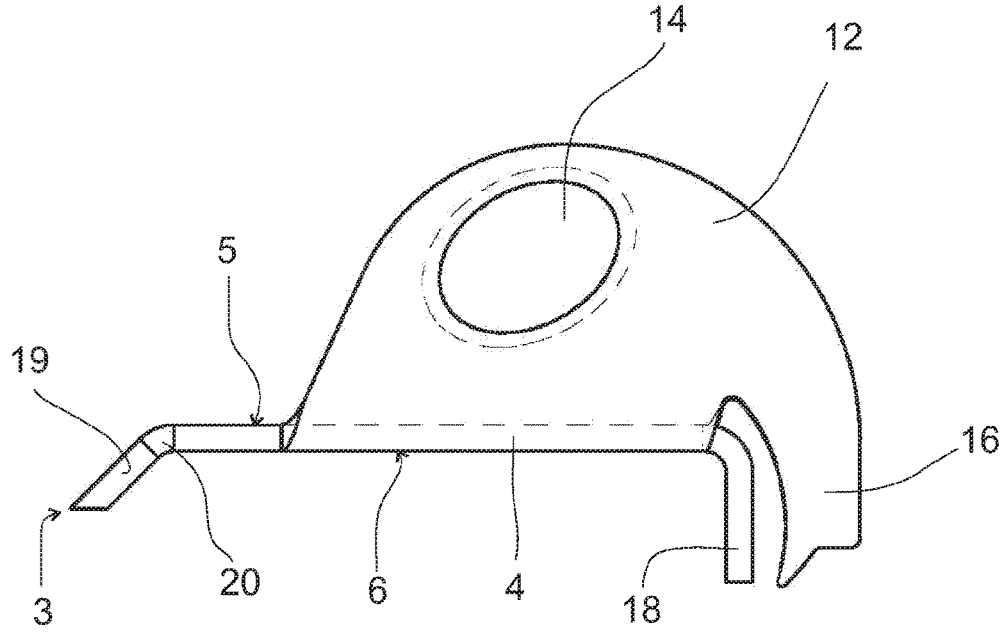
Figure 3:
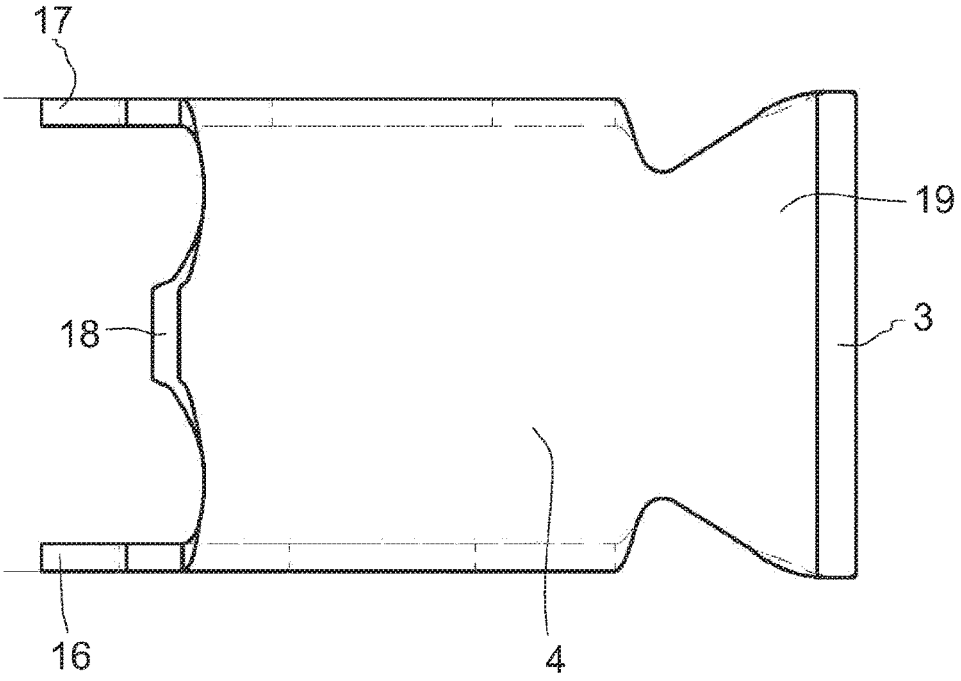
Figure 4:
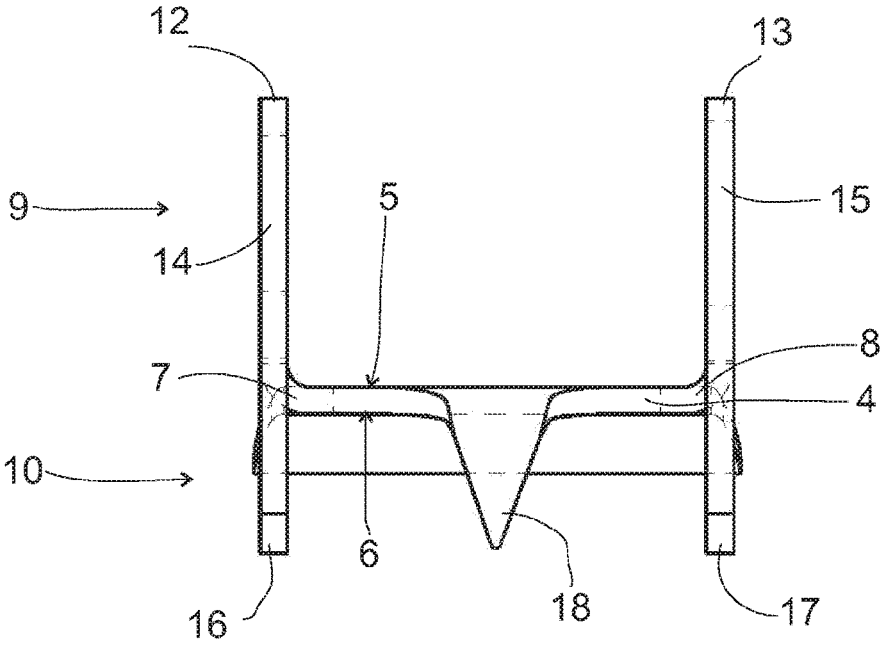
Figure 5:
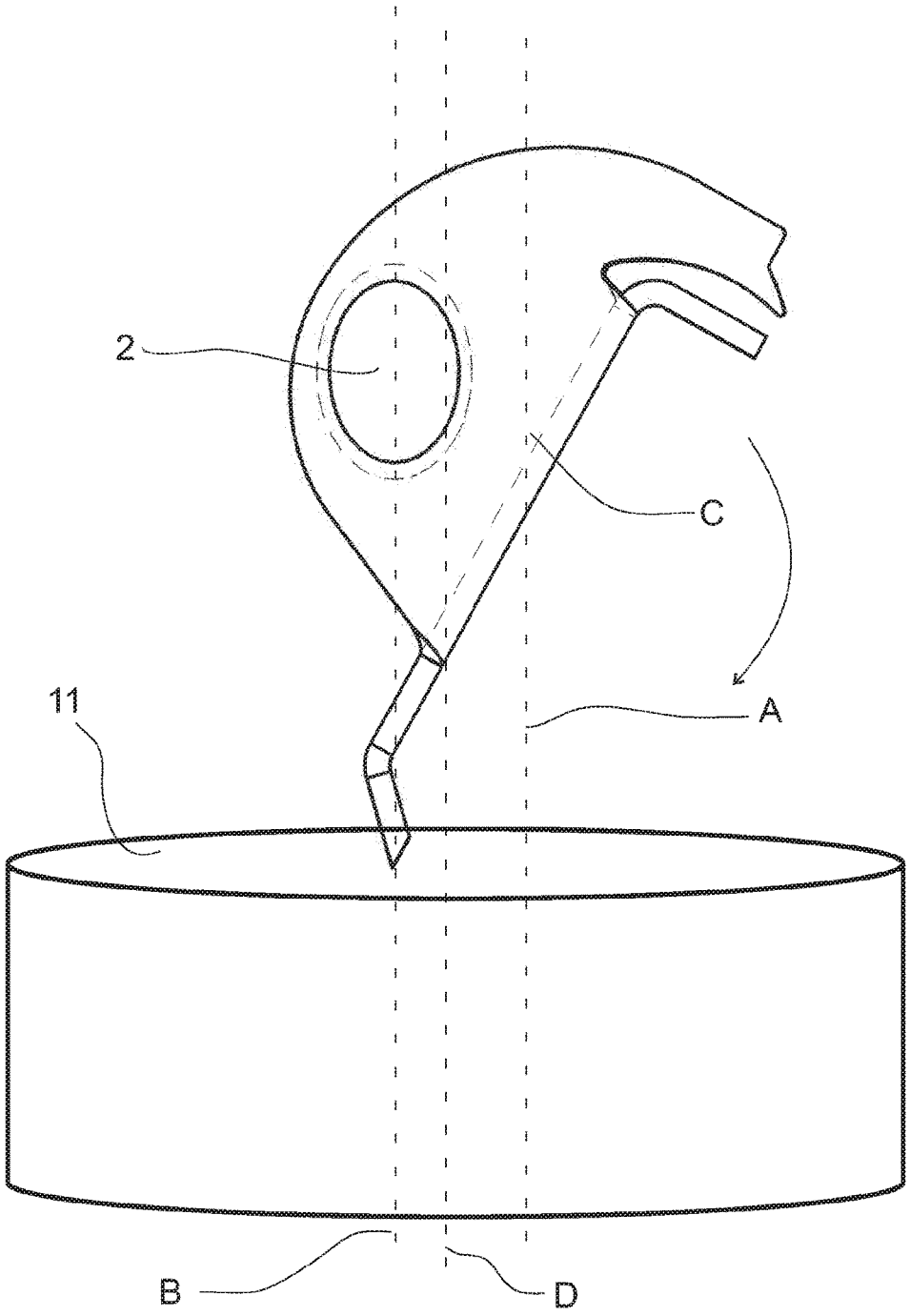
Figure 6:
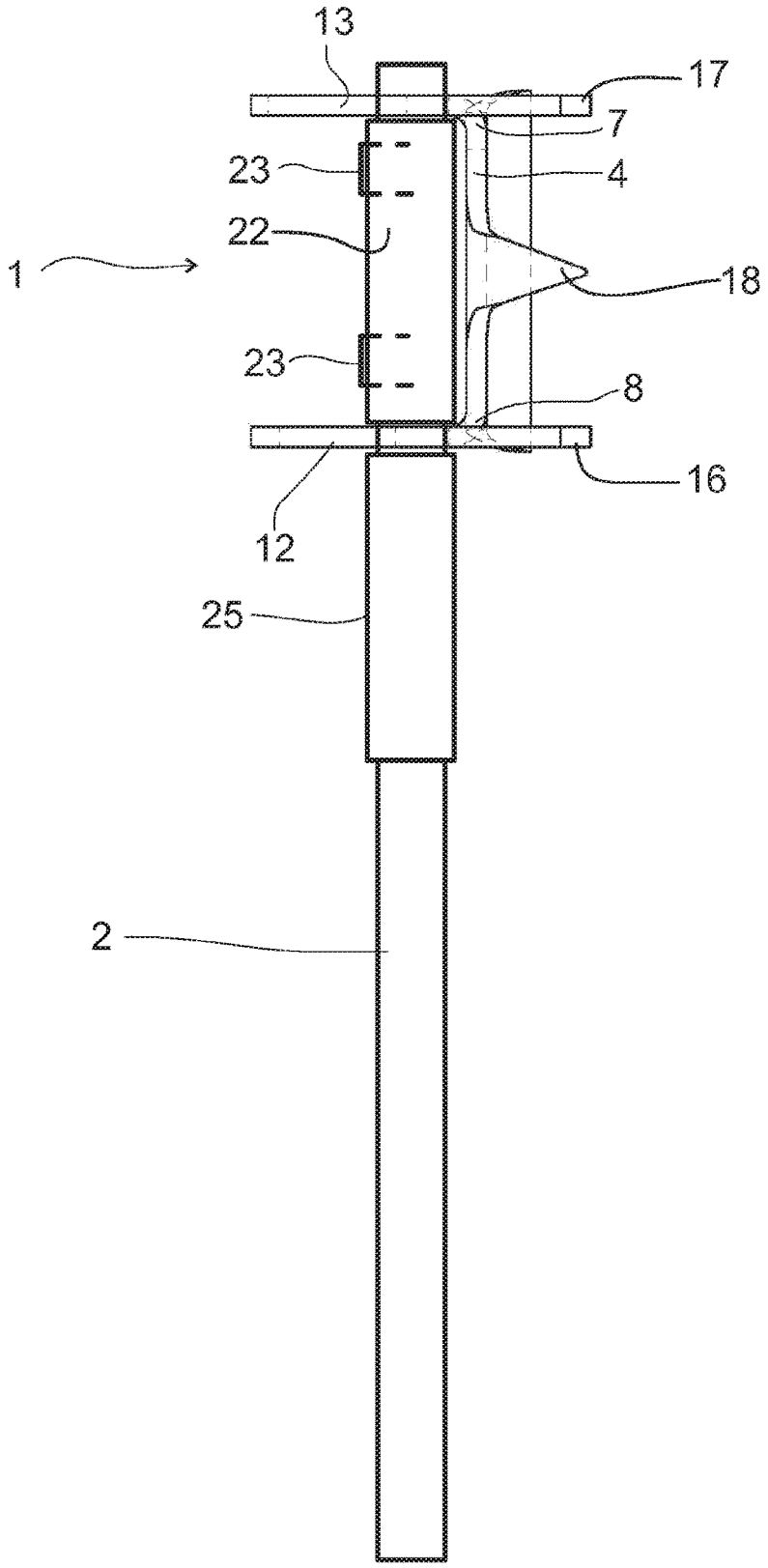
Figure 7:
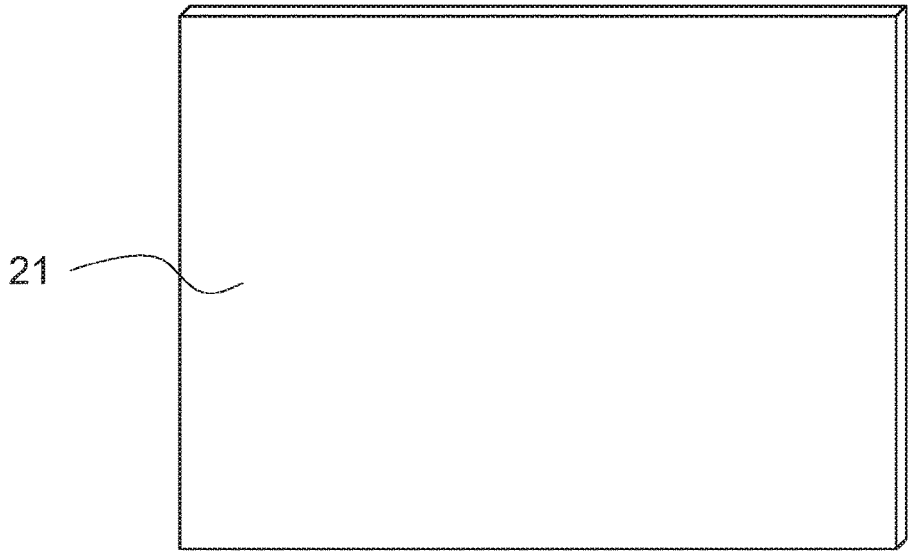
Figure 8:
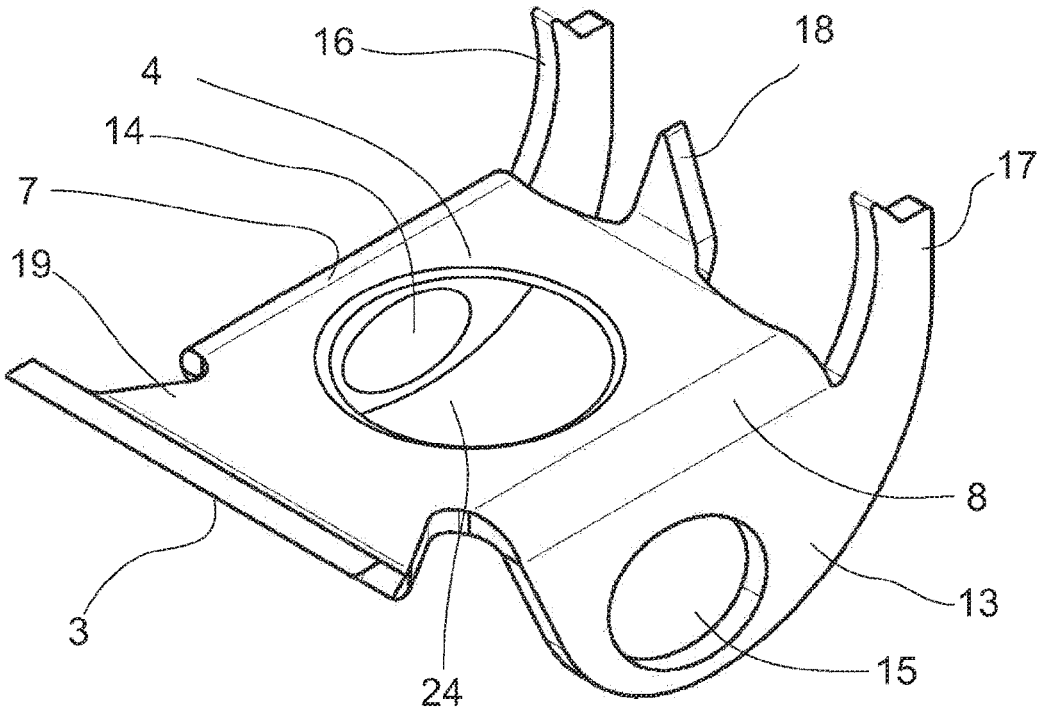
Figure 9:
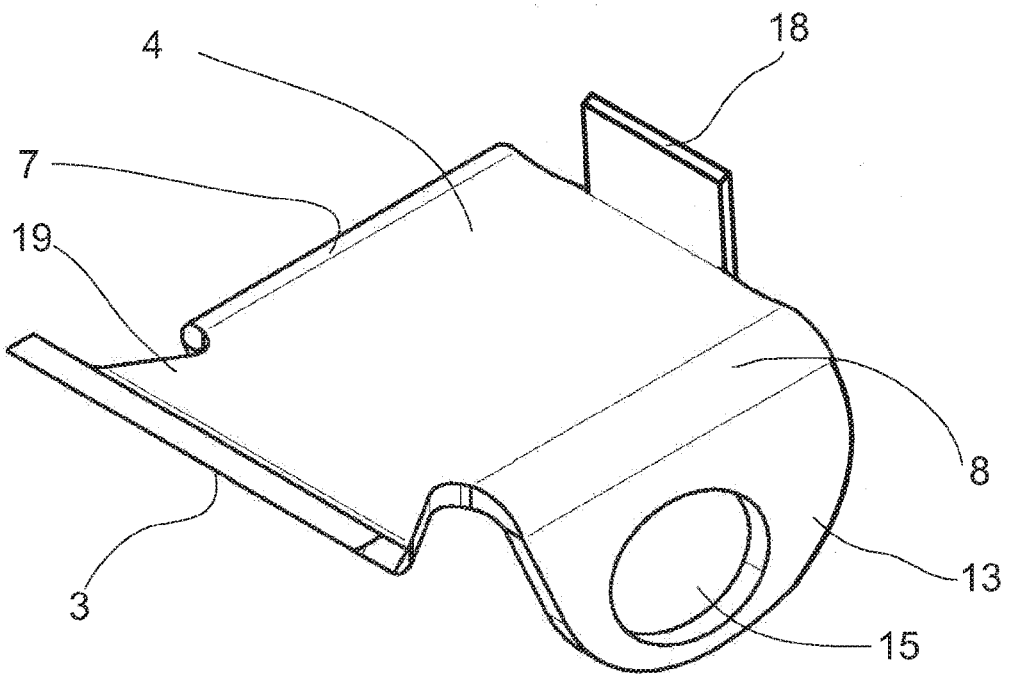
Figure 10:
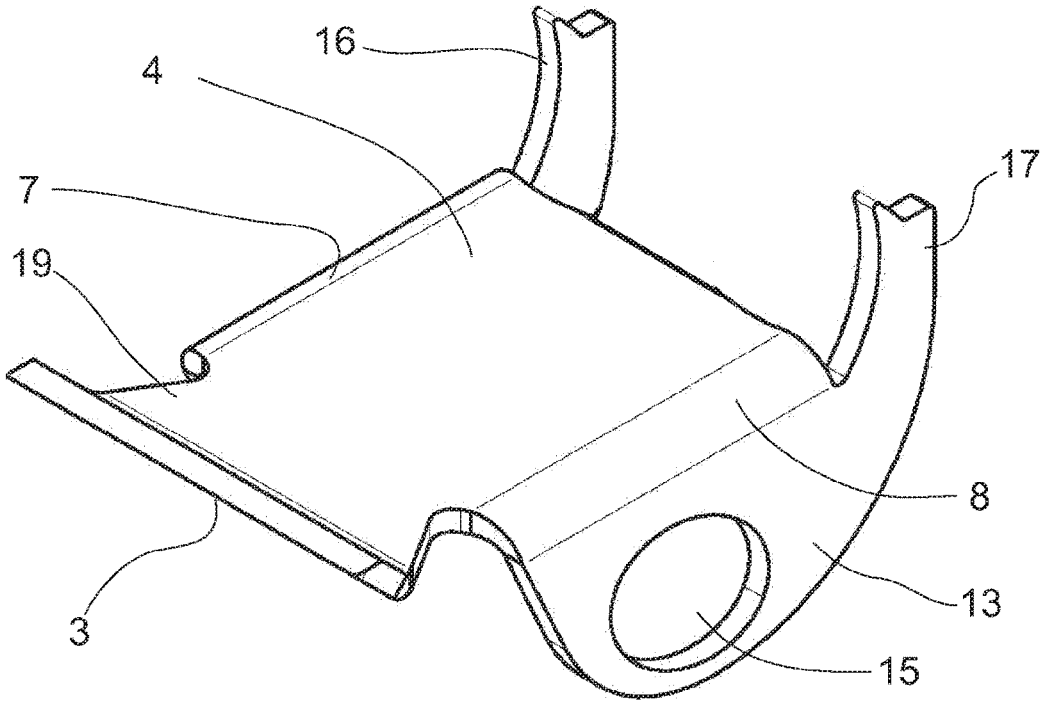
Figure 11:
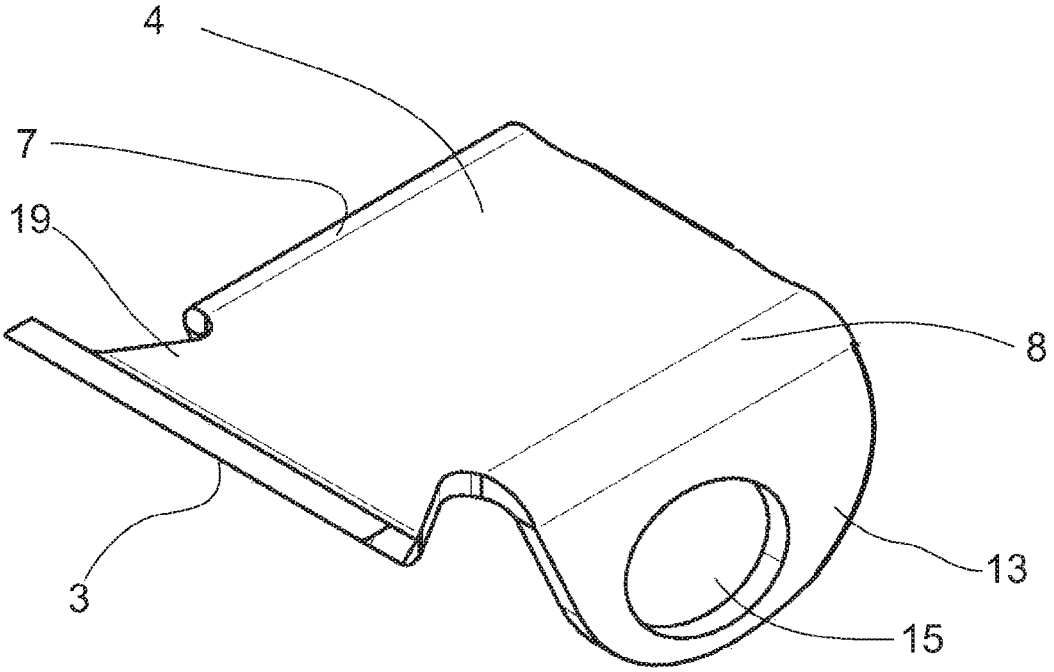

In the following the invention will described in more detail by referring to the figures, of which FIG. 1 shows an axe head according to an embodiment, FIG. 2 shows the axe head shown in FIG. 1 as seen from one side, FIG. 3 shows the axe head shown in FIG. 1 as seen from the second side face, FIG. 4 shows the axe head shown in FIG. 1 as seen from another side, FIG. 5 shows the function principle of the axe according to an embodiment, FIG. 6 shows an axe according to an embodiment, FIG. 7 shows a flat blade stock of generally uniform thickness, FIG. 8 shows an axe head according to another embodiment, FIG. 9 shows an axe head according to yet another embodiment, FIG. 10 shows an axe head according to still another embodiment, and FIG. 11 shows an axe head according to still another embodiment.

DETAILED DESCRIPTION OF THE INVENTION

The figures show examples of an axe and an axe head according to the invention.

First the axe and some preferred embodiments and variants of the axe will be described in greater detail.

The axe comprising an axe head 1 and a handle 2 to which one end portion the axe head 1 is mounted.

The axe head 1 is formed of a flat blade stock 21 of generally uniform thickness. The flat blade stock 21 is preferable, but not necessarily, made of steel such as duplex steel.

The axe head 1 has a sharpened cutting edge 3.

The axe head 1 has a frame section 4 comprising a first side face 5 and a second side face 6, and a first side edge 7 and a second side edge 8 between the first side face 5 and the second side face 6.

The axe head 1 defining a first axe head side 9 on the side of the first side face 5 of the frame section 4 and a second axe head side 10 on the second side face 6 of the frame section 4.

The centre of gravity (C) of the axe is located on a centre-of-gravity plane (A), which is parallel with a blade plane (B) on which the sharpened cutting edge 3 of the axe head 1 is located and which is located at a distance from the blade plane (B) and which is parallel with a normal working motion plane (D) of the axe.

The sharpened cutting edge 3 of the axe head 1 and the centre of gravity (C) of the axe are arranged to cooperate when the sharpened cutting edge 3 of the axe head 1 hits wood 11 to be split with the axe and the sharpened cutting edge 3 of the axe head 1 penetrates into the wood 11 such that at least some of the impact force of the axe head 1 is converted into a rotational motion of the axe head 1 and a motion of the axe head 1 in a curvilinear trajectory.

The axe head 1 having a first handle attaching structure 12, which extends from the first side edge 7 of the frame section 4 of the axe head 1 and which is located on the first axe head side 9 of the axe head 1.

The axe head 1 having a second handle attaching structure 13, which extends from the second side edge 8 of the frame section 4 of the axe head 1 and which is located on the first axe head side 9 of the axe head 1.

The frame section 4 of the axe head 1, the first handle attaching structure 12 of the axe head 1, the second handle attaching structure 13 of the axe head 1 are parts of a one-piece structure (not marked with a reference numeral)

formed by plastically deforming and cutting said flat blade stock 21 of generally uniform thickness.

The first handle attaching structure 12 is provided with a first opening 14 that is penetrated by the handle 2. The first opening 14 is preferably, but not necessarily, elliptic in shape, as shown in the drawings. The cross-sectional shape and the dimensions of the first opening 14 corresponds preferably, but not necessarily, to the cross-sectional shape of the section of the handle 2 that is located inside the first opening 14.

The second handle attaching structure 13 is provided with a second opening 15 that is penetrated by the handle 2. The second opening 15 is preferably, but not necessarily, elliptic in shape, as shown in the drawings. The cross-sectional shape and the dimensions of the second opening 15 corresponds preferably, but not necessarily, to the cross-sectional shape of the section of the handle 2 that is located inside the second opening 15.

If the first opening 14 is elliptic in shape and second opening 15 elliptic in shape and if the handle 2 has an elliptic cross-sectional form, an imaginary extension the major axis (not marked with a reference numeral) of at least one of the first opening 14 and the second opening 15 cuts preferably, but not necessarily, the blade plane B at the sharpened cutting edge 3 of the axe head 1. This helps a user of the axe to know the location and the direction of the sharpened cutting edge 3 of the axe head 1 when using the axe.

The frame section 4 of the axe head 1 of the axe may, as in the embodiments shown in the figures, be essentially flat so that the first side face 5 and the second side face 6 of the frame section 4 of the axe head 1 are parallel. In such embodiments the first handle attaching structure 12 may, as in the embodiments shown in the figures, be essentially flat.

If the frame section 4 of the axe head 1 is essentially flat and the first handle attaching structure 12 is essentially flat, the first handle attaching structure 12 may extend essentially perpendicularly from the first side edge 7 of the frame section 4 of the axe head 1 in relation to the frame section 4 of the axe head 1.

The first handle attaching structure 12 may, as in the embodiments shown in the FIGS. 1 to 5 and 8 and 10, be provided with a first stop element 16 arranged to hit the wood 11 during the rotational motion of the axe head 1 and the motion of the axe head 1 in a curvilinear trajectory. In such embodiments the first stop element 16 may, as in the embodiments shown in the figures, be essentially flat.

The first stop element 16 may, as in the embodiments shown in the FIGS. 1 to 5 and 8 and 10, be a part of the one-piece structure formed by plastically deforming and cutting said flat blade stock 21 of generally uniform thickness.

The first stop element 16 may, as in the embodiments shown in the FIGS. 1 to 5 and 8 and 10, be provided on the second axe head side 10 of the axe head 1.

The first stop element 16 may, as in the embodiments shown in the FIGS. 1 to 5 and 8 and 10, be essentially flat.

If the frame section 4 of the axe head 1 is essentially flat and the first stop element 16 is essentially flat, the first stop element 16 may extend essentially perpendicularly in relation to the frame section 4 of the axe head 1.

If the first handle attaching structure 12 is essentially flat and the first stop element 16 is essentially flat, the first handle attaching structure 12 and the first stop element 16 form preferably, but not necessarily, as shown in the embodiments shown in the FIGS. 1 to 5 and 8 and 10, together an essentially flat structure.

The frame section 4 of the axe head 1 of the axe may, as in the embodiments shown in the figures, be essentially flat so that the first side face 5 and the second side face 6 of the frame section 4 of the axe head 1 are parallel. In such embodiments the second handle attaching structure 13 may, as in the embodiments shown in the figures, be essentially flat.

If the frame section 4 of the axe head 1 is essentially flat and the second handle attaching structure 13 is essentially flat, the second handle attaching structure 13 may extend essentially perpendicularly from the second side edge 8 of the frame section 4 of the axe head 1 in relation to the frame section 4 of the axe head 1.

The second handle attaching structure 13 may, as in the embodiments shown in the FIGS. 1 to 5 and 8 and 10, be provided with a second stop element 17 arranged to hit the wood 11 during the rotational motion of the axe head 1 and the motion of the axe head 1 in a curvilinear trajectory. In such embodiments the second stop element 17 may, as in the embodiments shown in the FIGS. 1 to 5 and 8 and 10, be essentially flat.

The second stop element 17 may, as in the embodiments shown in the FIGS. 1 to 5 and 8 and 10, be a part of the one-piece structure formed by plastically deforming and cutting said flat blade stock 21 of generally uniform thickness.

The second stop element 17 may, as in the embodiments shown in the FIGS. 1 to 5 and 8 and 10, be provided on the second axe head side 10 of the axe head 1.

The second stop element 17 may, as in the embodiments shown in the figures, be essentially flat.

If the frame section 4 of the axe head 1 is essentially flat and the second stop element 17 is essentially flat, the second stop element 17*s* may extend essentially perpendicularly in relation to the frame section 4 of the axe head 1.

If the second handle attaching structure 13 is essentially flat and the second stop element 17 is essentially flat, the second handle attaching structure 13 and the second stop element 17 form preferably, but not necessarily, as shown in the embodiments shown in the FIGS. 1 to 5 and 8 and 10, together an essentially flat structure.

The attaching section of the axe head 1 may, as in the embodiment shown in the FIGS. 1 to 5 and 8 to 9, be provided with a third stop element 18 arranged to hit the wood 11 during the rotational motion of the axe head 1 and the motion of the axe head 1 in a curvilinear trajectory. The third stop element 18 may, as in the embodiment shown in the FIGS. 1 to 5 and 8 to 9, be essentially flat. The third stop element 18 may, as in the embodiment shown in the FIGS. 1 to 5 and 8 to 9, be a part of the one-piece structure formed by plastically deforming and cutting said flat blade stock 21 of generally uniform thickness. The third stop element 18 may, as in the embodiment shown in the FIGS. 1 to 5 and 8 to 9, extend perpendicularly in relation to the attaching section of the axe head 1. The third stop element 18 may, as in the embodiment shown in the FIGS. 1 to 5 and 8 to 9, be provided on the second axe head side 10 of the axe head 1. The third stop element 18 may, as in the embodiments shown in the FIGS. 1 to 5 and 8 to 9, be connected to the frame section 1 of the axe head 1.

The sharpened cutting edge 3 may, as in the embodiment shown in the figures, be formed in a cutting portion 19 that is a part of the one-piece structure formed by plastically deforming and cutting said flat blade stock 21 of generally uniform thickness. The cutting portion 19 may, as in the embodiment shown in the figures, be essentially flat and the cutting portion 19 may, as in the embodiment shown in the figures, extend in an angle in relation to the attaching section of the axe head 1 on the second axe head side 10 of the axe head 1. The connection point between the cutting portion 19 and the frame portion may form a stop member 20 configured for preventing the axe head 1 from penetrating too deeply into the wood 11 before the rotational motion starts. The cutting portion 19 may alternatively extend in an at least partly curved configuration in relation to the attaching section of the axe head 1 on the second axe head side 10 of the axe head 1.

The first opening 14 of the first handle attaching structure 12 have preferably, but not necessarily, different shape and/or dimensions than the second opening 15 of the second handle attaching structure 13.

The first opening 14 of the first handle attaching structure 12 may have the same shape, but different dimensions than the second opening 15 of the second handle attaching structure 13.

The first opening 14 of the first handle attaching structure 12 and the second opening 15 of the second handle attaching structure 13 may in some embodiments have essentially identical configuration so that the first opening 14 of the first handle attaching structure 12 and the second opening 15 of the second handle attaching structure 13 are provided in an unaligned relationship with respect to the frame section 4 of the axe head 1.

The axe may, as shown in FIG. 6, comprise a sleeve 22 such as a polymer sleeve, which is at least partly fitted around the handle 2, and which is arranged at least partly between the first handle attaching structure 12 and the second handle attaching structure 13, and which is fastened to the handle 2 by means of fastening means such as external fastening means 23, for example by U-staples as shown in FIG. 6, to fasten the axe head to the handle 2.

In an embodiment of the axe, the end portion of the handle 2 at which the axe head 1 is mounted defines an attaching portion (not marked with a reference numeral) of the handle 2 and the opposite portion of the handle 2 defines a grab portion (not marked with a reference numeral) of the handle 2. In this embodiment of the axe the cross-sectional of the handle 2 tapers between the first opening 14 in first attaching structure 12 of the axe head 1 and the second opening 15 in the second attaching structure 13 of the axe head 1 towards the grab section of the handle 2. In this embodiment of the axe the cross-sectional of the first opening 14 in first attaching structure 12 of the axe head 1 is smaller than the cross-sectional of the second opening 15 in the second attaching structure 13 of the axe head 1. A such embodiment provides for good fastening of the axe head 1 to the handle 2, because for example the centrifugal force created during the use of the axe forces the axe head 1 towards the end of the handle 2 i.e. the attaching portion of the handle 2 having the larger cross-section resulting in a fixing force being created between the axe head 1 and the handle 2 each time the axe is used. In this preferred embodiment of the axe, the first opening 14 is preferably, but not necessarily, elliptic in shape and second opening 15 elliptic is preferably, but not necessarily, in shape so that the first opening 14 and the second opening 15 has preferably, but not necessarily, essentially identical shape, but different dimensions so that the first opening 14 has a smaller cross-sectional area than the second opening 15. In this preferred embodiment of the axe, the handle 2 has preferably, but not necessarily, an elliptic cross-sectional form that is smaller in the first opening 14 than in the second opening 15 so that cross-sectional shape so that the dimensions of the first opening 14 corresponds to the cross-sectional shape of the section of the handle 2 that is located inside the first opening 14 and so that the cross-sectional shape and the dimensions of the second opening 15 corresponds to the cross-sectional shape of the section of the handle 2 that is located inside the second opening 15.

An embodiment of the axe comprises least one weight-saving aperture 24 in the frame section 4, as shown in FIG. 8.

The axe may comprise releasable fastened weights (not shown in the figures) or fixedly fastened weights (not shown in the figures) for increasing/decreasing the weight of the axe.

A protective sleeve 25, such as a protective sleeve made of polymer may be provide at least partly around the handle 2 in the vicinity of the axe head 1 for protecting the handle 2 against impacts.

In the following the axe head 1 and some preferred embodiments of the axe head 1 will be described in greater detail.

The axe head 1 is formed of a flat blade stock 21 of generally uniform thickness. The flat blade stock 21 is preferable, but not necessarily, made of steel such as duplex steel.

The axe head 1 has a sharpened cutting edge 3.

The axe head 1 having a frame section 4 comprising a first side face 5 and a second side face 6 6, and a first side edge 7 and a second side edge 8 between the first side face 5 and the second side face 6.

The axe head 1 defining a first axe head side 9 on the side of the first side of the frame section 4 and a second axe head side 10 on the second side face 6 of the frame section 4.

The axe head 1 having a first handle attaching structure 12, which extends from the first side edge 7 of the frame section 4 of the axe head 1 and which is located on the first axe head side 9 of the axe head 1.

The axe head 1 having a second handle attaching structure 13, which extends from the second side edge 8 of the frame section 4 of the axe head 1 and which is located on the first axe head side 9 of the axe head 1.

The frame section 4 of the axe head 1, the first handle attaching structure 12 of the axe head 1, the second handle attaching structure 13 of the axe head 1 are parts of a one-piece structure formed by plastically deforming and cutting said flat blade stock 21 of generally uniform thickness, The first handle attaching structure 12 is provided with a first opening 14 for a handle 2. The first opening 14 is preferably, but not necessarily, elliptic in shape, as shown in the drawings.

The second handle attaching structure 13 is provided with a second opening 15 for a handle 2. The second opening 15 is preferably, but not necessarily, elliptic in shape, as shown in the drawings.

If the first opening 14 is elliptic in shape and second opening 15 elliptic in shape, an imaginary extension the major axis (not marked with a reference numeral) of at least one of the first opening 14 and the second opening 15 cuts preferably, but not necessarily, the sharpened cutting edge 3 of the axe head 1 or an imaginary extension (not shown in the drawings) of the sharpened cutting edge 3 of the axe head 1.

The frame section 4 of the axe head 1 of the axe may, as in the embodiments shown in the figures, be essentially flat so that the first side face 5 and the second side face 6 of the frame section 4 of the axe head 1 are parallel. In such embodiments the first handle attaching structure 12 may, as in the embodiments shown in the figures, be essentially flat.

If the frame section 4 of the axe head 1 is essentially flat and the first handle attaching structure 12 is essentially flat, the first handle attaching structure 12 may extend essentially perpendicularly from the first side edge 7 of the frame section 4 of the axe head 1 in relation to the frame section 4 of the axe head 1.

The first handle attaching structure 12 may, as in the embodiments shown in the FIGS. 1 to 5 and 8 and 10, be provided with a first stop element 16 arranged to hit the wood 11 during the rotational motion of the axe head 1 and the motion of the axe head 1 in a curvilinear trajectory. In such embodiments the first stop element 16 may, as in the embodiments shown in the FIGS. 1 to 5 and 8 and 10, be essentially flat.

The first stop element 16 may, as in the embodiments shown in the FIGS. 1 to 5 and 8 and 10, be a part of the one-piece structure formed by plastically deforming and cutting said flat blade stock 21 of generally uniform thickness.

The first stop element 16 may, as in the embodiments shown in the FIGS. 1 to 5 and 8 and 10, be provided on the second axe head side 10 of the axe head 1.

The first stop element 16 may, as in the embodiments shown in the FIGS. 1 to 5 and 8 and 10, be essentially flat.

If the frame section 4 of the axe head 1 is essentially flat and the first stop element 16 is essentially flat, the first stop element 16*s* may extend essentially perpendicularly in relation to the frame section 4 of the axe head 1.

If the first handle attaching structure 12 is essentially flat and the first stop element 16 is essentially flat, the first handle attaching structure 12 and the first stop element 16 form preferably, but not necessarily, as shown in the embodiments shown in the FIGS. 1 to 5 and 8 and 10, together an essentially flat structure.

The frame section 4 of the axe head 1 of the axe may, as in the embodiments shown in the figures, be essentially flat so that the first side face 5 and the second side face 6 of the frame section 4 of the axe head 1 are parallel. In such embodiments the second handle attaching structure 13 may, as in the embodiments shown in the figures, be essentially flat.

If the frame section 4 of the axe head 1 is essentially flat and the second handle attaching structure 13 is essentially flat, the second handle attaching structure 13 may extend essentially perpendicularly from the second side edge 8 of the frame section 4 of the axe head 1 in relation to the frame section 4 of the axe head 1.

The second handle attaching structure 13 may, as in the embodiments shown in the FIGS. 1 to 5 and 8 and 10, be provided with a second stop element 17 arranged to hit the wood 11 during the rotational motion of the axe head 1 and the motion of the axe head 1 in a curvilinear trajectory. In such embodiments the second stop element 17 may, as in the embodiments shown in the FIGS. 1 to 5 and 8 and 10, be essentially flat.

The second stop element 17 may, as in the embodiments shown in the FIGS. 1 to 5 and 8 and 10, be a part of the one-piece structure formed by plastically deforming and cutting said flat blade stock 21 of generally uniform thickness.

The second stop element 17 may, as in the embodiments shown in the FIGS. 1 to 5 and 8 and 10, be provided on the second axe head side 10 of the axe head 1.

The second stop element 17 may, as in the embodiments shown in the FIGS. 1 to 5 and 8 and 10, be essentially flat.

If the frame section 4 of the axe head 1 is essentially flat and the second stop element 17 is essentially flat, the second stop element 17*s* may extend essentially perpendicularly in relation to the frame section 4 of the axe head 1.

If the second handle attaching structure 13 is essentially flat and the second stop element 17 is essentially flat, the second handle attaching structure 13 and the second stop element 17 form preferably, but not necessarily, as shown in the embodiments shown in the FIGS. 1 to 5 and 8 and 10, together an essentially flat structure.

The attaching section of the axe head 1 may, as in the embodiment shown in the FIGS. 1 to 5 and 8 to 9, be provided with a third stop element 18 arranged to hit the wood 11 during the rotational motion of the axe head 1 and the motion of the axe head 1 in a curvilinear trajectory. The third stop element 18 may, as in the embodiment shown in the FIGS. 1 to 5 and 8 to 9, be essentially flat. The third stop element 18 may, as in the embodiment shown in the FIGS. 1 to 5 and 8 to 9, be a part of the one-piece structure formed by plastically deforming and cutting said flat blade stock 21 of generally uniform thickness. The third stop element 18 may, as in the embodiment shown in the FIGS. 1 to 5 and 8 to 9, extend perpendicularly in relation to the attaching section of the axe head 1. The third stop element 18 may, as in the embodiment shown in the FIGS. 1 to 5 and 8 to 9, be provided on the second axe head side 10 of the axe head 1.

The sharpened cutting edge 3 may, as in the embodiment shown in the figures, be formed in a cutting portion 19 that is a part of the one-piece structure formed by plastically deforming and cutting said flat blade stock 21 of generally uniform thickness. The cutting portion 19 may, as in the embodiment shown in the figures, be essentially flat and the cutting portion 19 may, as in the embodiment shown in the figures, extend in an angle in relation to the attaching section of the axe head 1 on the second axe head side 10 of the axe head 1. The connection point between the cutting portion 19 and the frame portion may form a stop member 20 configured for preventing the axe head from penetrating too deeply into the wood 11 before the rotational motion starts. The cutting portion 19 may alternatively extend in an at least partly curved configuration in relation to the attaching section of the axe head 1 on the second axe head side 10 of the axe head 1.

The first opening 14 of the first handle attaching structure 12 have preferably, but not necessarily, different shape and/or dimensions than the second opening 15 of the second handle attaching structure 13.

The first opening 14 of the first handle attaching structure 12 may have the same shape, but different dimensions than the second opening 15 of the second handle attaching structure 13.

The first opening 14 of the first handle attaching structure 12 and the second opening 15 of the second handle attaching structure 13 may in some embodiments have essentially identical configuration so that the first opening 14 of the first handle attaching structure 12 and the second opening 15 of the second handle attaching structure 13 are provided in an unaligned relationship with respect to the frame section 4 of the axe head 1.

The axe head 2 may comprise releasable fastened weights (not shown in the figures) or fixedly fastened weights (not shown in the figures) for increasing/decreasing the weight of the axe head 2.

It is obvious for a person skilled in the art that even if the axe illustrated in FIG. 6 comprises an axe head 1 according to the embodiment shown in FIGS. 1 to 5, the axe head 2 can have a different configuration such as a configuration shown in any of the FIGS. 8 to 11.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. An axe comprising:

an axe head and a handle to which one end portion of the axe head is mounted, wherein the axe head is formed of a flat blade stock of generally uniform thickness, wherein the axe head having a sharpened cutting edge, wherein the axe head having a frame section comprising a first side face and a second side face, and a first side edge and a second side edge between the first side face and the second side face, wherein the axe head defining a first axe head side on the first side face of the frame section and a second axe head side on the second side face of the frame section, wherein the centre of gravity of the axe is located on a centre-of-gravity plane, which is parallel with a blade plane on which the sharpened cutting edge of the axe head is located and which is located at a distance from the blade plane and which is parallel with a normal working motion plane of the axe, wherein the sharpened cutting edge of the axe head and the centre of gravity of the axe are arranged to cooperate when the sharpened cutting edge of the axe head hits a wood and the sharpened cutting edge of the axe head penetrates into the wood such that at least some of the impact force of the axe head is converted into a rotational motion of the axe head and a motion of the axe head in a curvilinear trajectory, and wherein:

the axe head having a first handle attaching structure, which extends from the first side edge of the frame section of the axe head and which is located on the first axe head side of the axe head, the axe head having a second handle attaching structure, which extends from the second side edge of the frame section of the axe head and which is located on the first axe head side of the axe head, the frame section of the axe head, the first handle attaching structure of the axe head, the second handle attaching structure of the axe head are parts of a one-piece structure formed by plastically deforming and cutting said flat blade stock of generally uniform thickness, the first handle attaching structure being provided with a first opening that is penetrated by the handle, and the second handle attaching structure being provided with a second opening that is penetrated by the handle.

2. The axe according to claim 1, wherein:

the frame section of the axe head being essentially flat so that the first side face and the second side face of the frame section of the axe head being parallel, the first handle attaching structure being essentially flat, and the first handle attaching structure extends essentially perpendicularly from the first side edge of the frame section of the axe head in relation to the frame section of the axe head.

3. The axe according to claim 1, wherein:

the first handle attaching structure being provided with a first stop element arranged to hit the wood during the rotational motion of the axe head and the motion of the axe head in a curvilinear trajectory, the first stop element being essentially flat and being a part of the one-piece structure formed by plastically deforming and cutting said flat blade stock of generally uniform thickness, and the first stop element being provided on the second axe head side of the axe head.

4. The axe according to claim 1, wherein:

the second handle attaching structure being provided with a second stop element arranged to hit the wood during the rotational motion of the axe head and the motion of the axe head in a curvilinear trajectory, the second stop element being essentially flat and being a part of the one-piece structure formed by plastically deforming and cutting said flat blade stock of generally uniform thickness, and the second stop element being provided on the second axe head side of the axe head.

5. The axe according to claim 1, wherein:

an attaching section of the axe head is provided with a third stop element arranged to hit the wood during the rotational motion of the axe head and the motion of the axe head in a curvilinear trajectory, the third stop element being essentially flat and being a part of the one-piece structure formed by plastically deforming and cutting said flat blade stock of generally uniform thickness, the third stop element extends perpendicularly in relation to the attaching section of the axe head, and the third stop element being provided on the second axe head side of the axe head.

6. The axe according to claim 5, wherein:

the sharpened cutting edge being formed in a cutting portion that is a part of the one-piece structure formed by plastically deforming and cutting said flat blade stock of generally uniform thickness, and the cutting portion extends in an angle and/or in an curved configuration in relation to the attaching section of the axe head on the second axe head side of the axe head.

7. The axe according to claim 1, wherein:

the first opening having a different shape and/or dimensions than the second opening.

8. The axe according to claim 1, wherein:

a sleeve which is at least partly fitted around the handle, and which is arranged at least partly between the first handle attaching structure and the second handle attaching structure, and the sleeve being fastened to the handle by means of fastening means.

9. The axe head according to claim 8, wherein:

the first opening has a different shape and/or dimensions than the second opening.

10. The axe head according to claim 8, wherein:

the first opening is elliptic in shape and the second opening is elliptic in shape, and a major axis of at least one of the first opening and the second opening cuts the sharpened cutting edge of the axe head or an imaginary extension of the sharpened cutting edge of the axe head.

11. The axe according to claim 1, wherein:

an end portion of the handle at which the axe head is mounted defines an attaching portion of the handle and an opposite portion of the handle defines a grab portion of the handle, a cross-section of the handle tapers between the first opening in the first handle attaching structure of the axe head and the second opening in the second handle attaching structure of the axe head towards the grab portion of the handle, and a cross-section of the first opening in the first handle attaching structure of the axe head being smaller than a cross-section of the second opening in the second handle attaching structure of the axe head.

12. The axe according to claim 1, wherein:

the first opening is elliptic in shape and the second opening is elliptic in shape, and a major axis of at least one of the first opening and the second opening cuts the blade plane at the sharpened cutting edge of the axe head.

13. An axe head wherein the axe head is formed of a flat blade stock of generally uniform thickness, the axe head comprising:

a sharpened cutting edge, wherein the axe head has a frame section including a first side face and a second side face, and a first side edge and a second side edge between the first side face and the second side face, wherein the axe head defines a first axe head side on the first side face of the frame section and a second axe head side on the second side face of the frame section, wherein the axe head has a first handle attaching structure, which extends from the first side edge of the frame section of the axe head and which is located on the first axe head side of the axe head, wherein the axe head has a second handle attaching structure, which extends from the second side edge of the frame section of the axe head and which is located on the first axe head side of the axe head, wherein the frame section of the axe head, the first handle attaching structure of the axe head, the second handle attaching structure of the axe head are parts of a one-piece structure formed by plastically deforming and cutting said flat blade stock of generally uniform thickness, wherein the first handle attaching structure being provided with a first opening for a handle, and wherein the second handle attaching structure being provided with a second opening for the handle.

14. The axe head according to claim 13, wherein:

the frame section of the axe head being essentially flat so that the first side face and the second side face of the frame section of the axe head being parallel, the first handle attaching structure being essentially flat, and the first handle attaching structure extends essentially perpendicularly from the first side edge of the frame section of the axe head in relation to the frame section of the axe head.

15. The axe head according to claim 13 wherein:

the first handle attaching structure being provided with a first stop element arranged to hit a wood during the rotational motion of the axe head and the motion of the axe head in a curvilinear trajectory, the first stop element being essentially flat and being a part of the one-piece structure formed by plastically deforming and cutting said flat blade stock of generally uniform thickness, and the first stop element being provided on the second axe head side of the axe head.

16. The axe head according to claim 13, wherein:

the second handle attaching structure being provided with a second stop element arranged to hit a wood during the rotational motion of the axe head and the motion of the axe head in a curvilinear trajectory, the second stop element being essentially flat and being a part of the one-piece structure formed by plastically deforming and cutting said flat blade stock of generally uniform thickness, and the second stop element being provided on the second axe head side of the axe head.

17. The axe head according to claim 13, wherein:

an attaching section of the axe head being provided with a third stop element arranged to hit the wood during the rotational motion of the axe head and the motion of the axe head in a curvilinear trajectory, the third stop element being essentially flat and being a part of the one-piece structure formed by plastically deforming and cutting said flat blade stock of generally uniform thickness, the third stop element extends perpendicularly in relation to the attaching section of the axe head, and the third stop element being provided on the second axe head side of the axe head.

18. The axe head according to claim 17, wherein:

the sharpened cutting edge being formed in a cutting portion that is a part of the one-piece structure formed by plastically deforming and cutting said flat blade stock of generally uniform thickness, and the cutting portion extends in an angle and/or in an curved configuration in relation to the attaching section of the axe head on the second axe head side of the axe head.

* * * * *